US008435358B2

(12) United States Patent
Disch et al.

(10) Patent No.: US 8,435,358 B2
(45) Date of Patent: May 7, 2013

(54) CONVEYOR DISHWASHER AND METHOD FOR OPERATING A CONVEYOR DISHWASHER

(75) Inventors: Harald Disch, Elzach (DE); Martin Schrempp, Gengenbach (DE); Norbert Litterst, Offenburg (DE)

(73) Assignee: Premark FEG L.L.C., Glenview, IL (US)

( * ) Notice: Subject to any disclaimer, the term of this patent is extended or adjusted under 35 U.S.C. 154(b) by 133 days.

(21) Appl. No.: 13/058,241

(22) PCT Filed: Aug. 12, 2009

(86) PCT No.: PCT/US2009/053534

§ 371 (c)(1),
(2), (4) Date: Feb. 9, 2011

(87) PCT Pub. No.: WO2010/019653

PCT Pub. Date: Feb. 18, 2010

(65) Prior Publication Data

US 2011/0132408 A1 Jun. 9, 2011

(30) Foreign Application Priority Data

Aug. 14, 2008 (DE) ..... 10 2008 037 683

(51) Int. Cl.
*B08B 3/02* (2006.01)

(52) U.S. Cl.
USPC ..... 134/25.2; 134/15; 134/18; 134/30; 134/32; 134/34; 134/36; 134/37; 134/42; 134/70; 134/71; 134/72; 134/99.1; 134/56 R; 134/56 D; 134/57 R; 134/58 R; 134/58 D; 134/131

(58) Field of Classification Search ..... 134/15, 134/18, 25.2, 30, 32, 34, 36, 37, 42, 70, 71, 134/134/72, 99.1, 56 R, 57 D, 56 D, 58 R, 134/58 D, 131
See application file for complete search history.

(56) References Cited

U.S. PATENT DOCUMENTS

| | | | | |
|---|---|---|---|---|
| 5,320,118 | A | 6/1994 | Fernholz | |
| 5,876,515 | A | 3/1999 | Värpiö | |
| 6,058,946 | A | 5/2000 | Bellati et al. | |
| 6,530,996 | B2 | 3/2003 | Värpiö | |
| 2004/0173249 | A1 * | 9/2004 | Assmann et al. | 134/94.1 |
| 2006/0213543 | A1 | 9/2006 | Litterst et al. | |
| 2007/0034234 | A1 | 2/2007 | Holzman et al. | |

(Continued)

FOREIGN PATENT DOCUMENTS

| | | |
|---|---|---|
| DE | 19608030 | 7/1997 |
| DE | 69525337 | 3/2003 |

(Continued)

OTHER PUBLICATIONS

PCT, International Preliminary Report on Patentability, International Application No. PCT/US2009/053534 (Feb. 24, 2011).

(Continued)

*Primary Examiner* — Bibi Carrillo
(74) *Attorney, Agent, or Firm* — Thompson Hine LLP

(57) ABSTRACT

A conveyor dishwasher (2) has a control apparatus (50) for automatically setting the quantity of final rinse liquid sprayed in the final rinse zone (18) per unit time as a function of the conveying speed and/or as a function of the type of washware conveyed through the final rinse zone (18). A rinse aid metering apparatus (57) is also provided which is designed to add in a metered fashion a constant quantity of rinse aid per unit time to the fresh water provided for final rinsing purposes independently of the quantity of final rinse liquid sprayed in the final rinse zone (18) per unit time.

14 Claims, 2 Drawing Sheets

U.S. PATENT DOCUMENTS

Figure 1:
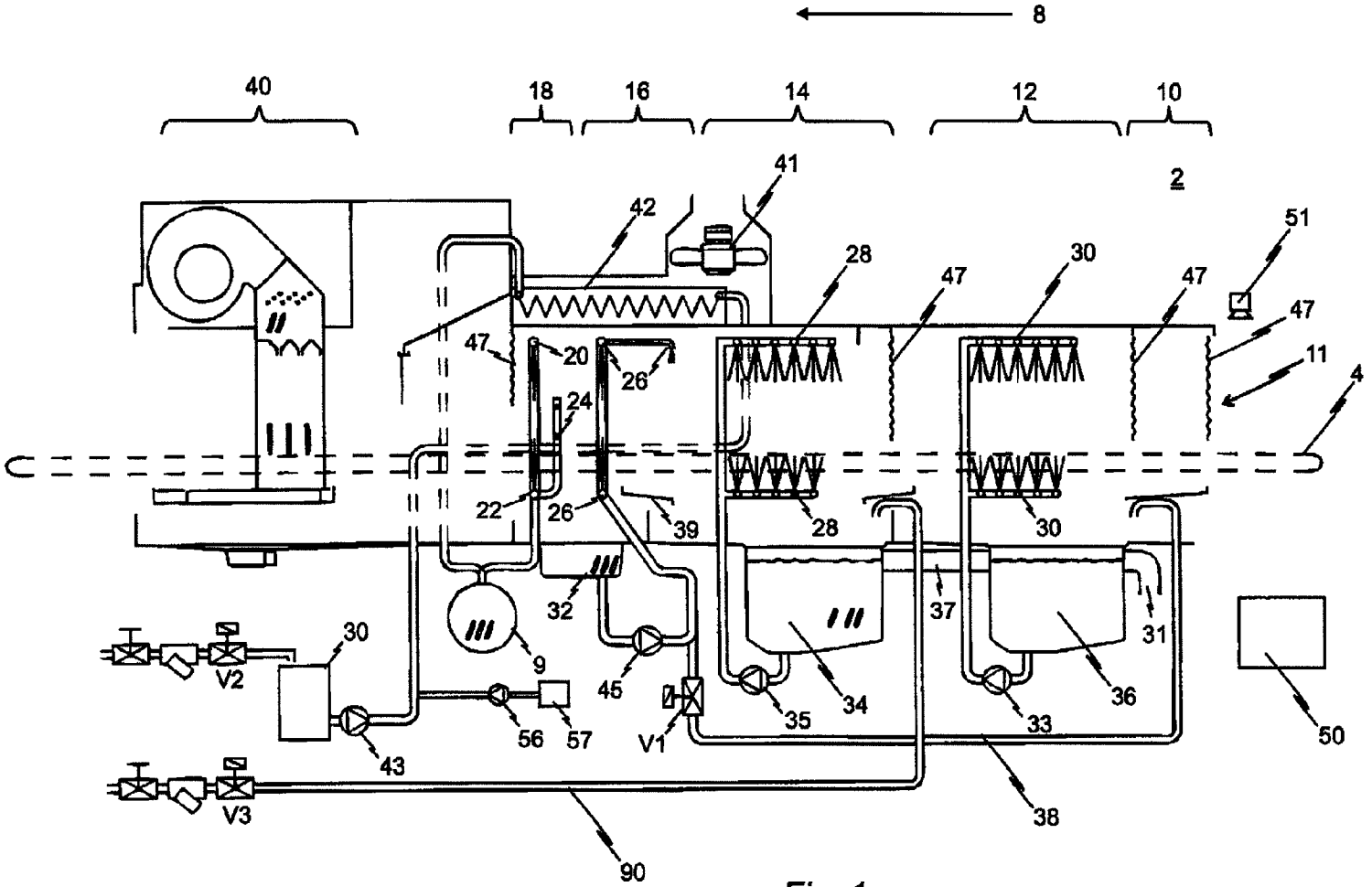

| | | | | |
|---|---|---|---|---|
| 2011/0005551 | A1* | 1/2011 | Berner et al. | 134/25.2 |
| 2011/0017240 | A1* | 1/2011 | Berner et al. | 134/25.2 |
| 2011/0139186 | A1* | 6/2011 | Disch et al. | 134/25.2 |

FOREIGN PATENT DOCUMENTS

| | | |
|---|---|---|
| DE | 19608036 | 9/2004 |
| DE | 102005021101 | 5/2006 |
| DE | 102005023429 | 11/2006 |

OTHER PUBLICATIONS

PCT, International Search Report and Written Opinion, International Application No. PCT/US2009/053534 (Sep. 24, 2009).

Germany, Search Report, German Application No. 10 2008 037 683.3 (Jul. 1, 2009).

* cited by examiner

CONVEYOR DISHWASHER AND METHOD FOR OPERATING A CONVEYOR DISHWASHER

The invention relates to a conveyor dishwasher comprising a conveyor apparatus for conveying washware through at least one wash zone and at least one final rinse zone, with final rinse liquid, which comprises fresh water with rinse aid which is added in a metered fashion, being sprayed onto the washware in the at least one final rinse zone by means of spray nozzles. The invention also relates to a method for operating a conveyor dishwasher of this type.

Accordingly, the invention relates, in particular, to a flight-type dishwasher (flight-type warewasher) or a rack conveyor dishwasher (rack conveyor warewasher).

BACKGROUND OF THE INVENTION

Conveyor dishwashers (conveyor warewashers) are used in the commercial sector. In contrast to domestic dishwashers, in which the washware to be cleaned remains stationary in the machine during cleaning, in conveyor dishwashers the washware is conveyed through various treatment zones of the machine.

In the case of conveyor dishwashers, the washware, for example dishes, pots, glasses, cutlery and other articles which are to be cleaned, is conveyed through a plurality of treatment zones, for example prewash zone(s), main wash zone(s), post-wash or pre-rinse zone(s), final-rinse zone(s) and drying zone(s). A conveyor apparatus which generally has compartments for accommodating washware is used to convey washware in a conveying direction through the conveyor dishwasher. In the case of a flight-type dishwasher, the compartments can be formed by supporting fingers on a conveyor belt of the conveyor apparatus. In the case of rack conveyor dishwashers, dish racks in which compartments can be formed in order to accommodate the washware to be treated serve as the conveyor apparatus. It is feasible here for the dish racks to be conveyed through the rack conveyor dishwasher by a conveying device.

U.S. Pat. No. 6,530,996 B2 describes a rack conveyor dishwasher in which the washware to be treated is fed to the respective treatment zones in a state in which it is pre-sorted in dish racks. This conveyor dishwasher which is known from the prior art is provided with sensors with can be used to detect an identifying feature which is fitted on the dish rack and indicates the type of washware accommodated in the dish rack. A suitable washing and/or rinsing programme of the rack conveyor dishwasher can be selected as a function of the detected identifying feature.

DE 196 08 030 C1 discloses a conveyor dishwasher in which, depending on the type and degree of soiling of the washware to be cleaned in the individual treatment zones of the conveyor dishwasher, additional spray systems are switched on or off in order to change the size of the action section in the treatment zones.

It is already known from DE 10 2005 021 101 A1 to switch on or switch off additional spray nozzles in a conveyor dishwasher as a function of the conveying speed in the final rinse zone, as a result of which the consumption of final rinse liquid during operation can be reduced. Sensors are provided at the entrance of the conveyor dishwasher in order to detect washware. The conveying speed is automatically reduced when the quantity of washware entering the conveyor dishwasher decreases.

A similar conveyor dishwasher is also known from DE 695 25 337 T2. In this prior art document, a sensor is used to detect the presence of washware to be treated. If no washware is present, washing operation is interrupted until washware passes the sensor again.

Finally, DE 196 08 036 C5 discloses a further conveyor dishwasher in which the quantity of final rinse liquid sprayed in the final rinse zone per unit time is changed as a function of the conveying speed and as a function of the respective rinsing programme. The quantity of fresh water sprayed during final rinsing and the quantity of rinse aid used for final rinsing are in each case coupled to the conveying speed and to the respective rinsing programme and are changed as a function of these.

BRIEF SUMMARY OF THE INVENTION

The invention is based on the object of developing a conveyor dishwasher of the type mentioned in the introduction in such a way that an optimum final rinse result can be achieved in spite of a reduction in the consumption of fresh water and energy for the washware to be treated. A further object to be achieved is that of specifying a corresponding method for operating a conveyor dishwasher of this type.

The advantages which can be achieved by the invention are obvious: firstly, a control apparatus is provided which is designed to set the quantity of final rinse liquid sprayed in the at least one final rinse zone per unit time, with the volumetric flow of the final rinse liquid supplied to the spray nozzles of the final rinse zone being automatically changed with the aid of the control apparatus as a function of the conveying speed at which the washware is conveyed at least through the final rinse zone and/or as a function of the type of washware conveyed through the final rinse zone. In this way, the final rinse liquid sprayed in the final rinse zone per unit time can be optimally matched to the type of washware to be treated and/or to the conveying speed at which the washware to be treated is conveyed through the at least one final rinse zone. As a result, the consumption of fresh water, which is sprayed in the at least one final rinse zone for final rinsing purposes, can be effectively reduced. On account of the lower consumption of fresh water, the quantity of water to be heated is lower, as a result of which energy is saved too.

Secondly, the solution according to the invention is distinguished in that, in addition to the control apparatus, a rinse aid metering apparatus is provided which is designed to add in a metered fashion a constant quantity of rinse aid per unit time to the fresh water provided for final rinsing purposes independently of the quantity of final rinse liquid sprayed in the at least one final rinse zone per unit time. According to the invention, the quantity of rinse aid supplied to the fresh water per unit time is accordingly not coupled to the volumetric flow of the final rinse liquid supplied to the spray nozzles of the final rinse zone.

The advantage of decoupling of this type can be seen, in particular, in that an optimum final rinse result can be consistently achieved in a manner which is implemented particularly simply, but is nevertheless effective, both for different types of washware and also for different conveying speeds. It should be noted here that the chemical metering technology, and in particular the technology for adding rinse aid in a metered fashion to the fresh water provided for final rinsing purposes, is generally not the responsibility of the machine manufacturer. The solution according to the invention allows the consumption of fresh water and energy to be reduced during operation of the conveyor dishwasher without the need for a proportional change in the quantity of metered rinse aid as a function of the volumetric flow of the fresh water provided for final rinsing purposes. The solution according to the invention can accordingly be implemented without having to interfere with the chemical metering technology, in particular the technology for adding rinse aid in a metered fashion.

It has surprisingly been found in the process that the result of final rinsing (effective rinsing-off of detergent residues from the surfaces of washware) is not adversely affected in any way when 0.2 to 0.8 ml of rinse aid, and preferably 0.3 to 0.6 ml of rinse aid, are added in a metered fashion per liter of fresh water to the fresh water provided for final rinsing purposes independently of the quantity of final rinse liquid sprayed in the final rinse zone per unit time.

Advantageous developments of the solution according to the invention are specified in the subclaims.

DETAILED DESCRIPTION OF THE DRAWINGS

Figure 2:
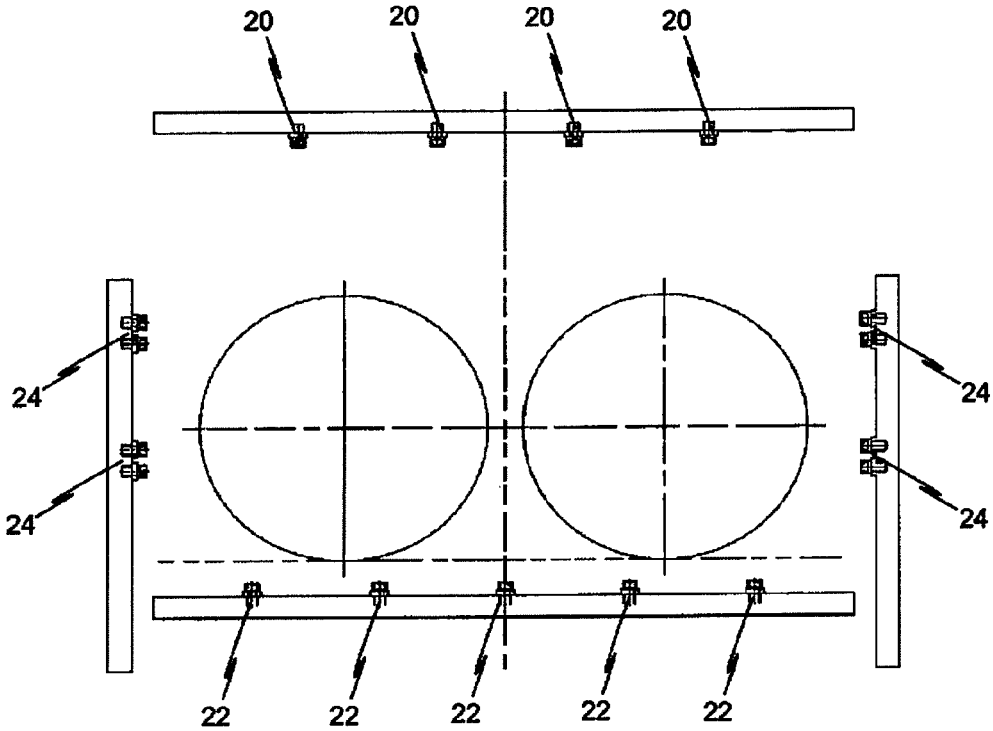

The invention will be described below by way of example on the basis of a preferred embodiment and with reference to the drawings, in which FIG. 1 shows a schematic longitudinal section through a conveyor dishwasher according to the invention; and FIG. 2 shows a cross-sectional view through the final rinse zone of the conveyor dishwasher according to FIG. 1.

DETAILED DESCRIPTION OF THE INVENTION

FIG. 1 shows a conveyor dishwasher 2 having a conveyor apparatus 4 for conveying washware (not illustrated) in a conveying direction 8 through the housing of the conveyor dishwasher 2. The conveyor dishwasher 2 has at least one wash zone, as illustrated in FIG. 1 for example, a prewash zone 12 and a main-wash zone 14 which is arranged downstream of the prewash zone 12 as seen in the conveying direction 8.

As seen in the conveying direction 8, a postwash zone 16 is arranged downstream of the at least one wash zone 12, 14, and at least one final rinse zone, for example only a single final rinse zone 18 as illustrated, is arranged downstream of the postwash zone 16. In the conveyor dishwasher 2 illustrated in FIG. 1, the final rinse zone 18 is followed in the conveying direction 8 of the washware by a drying zone 40. The respective zones 12, 14, 16, 18, 40 of the conveyor dishwasher 2 can be separated from one another by means of separating curtains 47. In the embodiment illustrated in FIG. 1, the inlet tunnel 10 itself is also separated from the inlet 11 by a separating curtain 47. The provision of the separating curtains 47 prevents wash liquid and final rinse liquid spraying between zones and prevents vapours escaping from the conveyor dishwasher 2.

The treatment zones 12, 14, 16, 18 of the conveyor dishwasher 2 have associated spray nozzles 20, 22, 24, 26, 28, 30. The spray nozzles 20, 22, 24, 26, 28, 30 serve to spray liquid onto the washware as the washware is conveyed through the respective treatment zones 12, 14, 16, 18 by the conveyor apparatus 4. The individual spray systems of the treatment zones 12, 14, 16, 18 ensure that the washware to be treated is hosed down both from the top and from the bottom.

However, in the conveyor dishwasher 2 schematically illustrated in FIG. 1, the final rinse zone 18 not only has downwardly directed upper spray nozzles 20 and upwardly directed lower spray nozzles 22, but also transversely directed lateral spray nozzles 24 on either side of the conveyor apparatus 4. The use of lateral spray nozzles 24 permits areas of the washware (areas of the dishes) to be sprayed with final rinse liquid in a targeted manner in shadow zones too. The use of lateral spray nozzles 24 in the final rinse zone 18 has a significant advantage in terms of the final rinse result (effective rinsing-off of detergent residues from dish surfaces in shadow zones too) over systems in which only upper and lower spray nozzles 20, 22 and no transversely directed nozzles 24 are provided in the final rinse zone 18, specifically when the conveying system is fully loaded, that is to say with plate-to-plate loading of the dish rack.

The postwash zone 16, main-wash zone 14 and prewash zone 12 also have associated tanks (postwash tank 32, main-wash tank 34, prewash tank 36) for accommodating sprayed liquid and/or for providing liquid for the spray nozzles 26, 28, 30 of the relevant treatment zones 14, 16, 18.

As already indicated, final rinse liquid, which comprises fresh water with rinse aid which is added in a metered fashion, is sprayed onto the washware (not illustrated) by means of spray nozzles 20, 22, 24 of the final rinse zone 18 which are arranged above and below the conveyor apparatus 4 and on the side in the conveyor dishwasher 2 illustrated in FIG. 1. A portion of the sprayed final rinse liquid is conveyed from treatment zone to treatment zone via a cascade system in the opposite direction to the conveying direction 8 of the washware. The remaining portion of the final rinse liquid sprayed in the final rinse zone 18 is conducted directly to the prewash tank 36 which is associated with the prewash zone 12 via a valve V1 and a bypass line 38.

In the cascade system, the final rinse liquid sprayed by the final rinse nozzles 20, 22, 24 flows from the final rinse zone 18 into the postwash tank 32 which is associated with the postwash zone 16 due to the force of gravity. The final rinse liquid sprayed in the final rinse zone 18 and collected by the postwash tank 32 is then delivered to the spray nozzles (postwash nozzles 26) of the postwash zone 16 with the aid of a postwash pump 45.

Wash liquid is rinsed off from the washware in the postwash zone 16. The liquid (postwash liquid) produced in the process flows into the main-wash tank 34, which is associated with the main-wash zone 14, due to the force of gravity. A discharge element 39, for example a discharge base or a baffle plate, which conducts the postwash liquid sprayed by the postwash nozzles 26 into the main-wash tank 34 is preferably provided for this purpose. According to another embodiment (not shown), the outlet element 39 can be dispensed with if the main-wash tank 34 extends as far as beneath the postwash nozzles 26 of the postwash zone 16.

The liquid accommodated by the main-wash tank 34 of the main-wash zone 14 is usually provided with a detergent and sprayed onto the washware by means of the spray nozzles (main-wash nozzles 28) of the main-wash zone 14 with the aid of a main-wash pump 35. The wash liquid sprayed by the main-wash nozzles 28 flows back into the main-wash tank 34 due to the force of gravity.

The main-wash tank 34 is fluidically connected to the prewash tank 36 associated with the prewash zone 12 via an overflow line 37. The wash liquid sprayed in the main-wash zone 14 enters the prewash tank 36 via this overflow line 37 when there is a sufficient quantity of wash liquid in the main-wash tank 34.

The liquid accommodated in the prewash tank 36 of the prewash zone 12 is then sprayed onto the washware by means of the spray nozzles (prewash nozzles 30) of the prewash zone 12 with the aid of a prewash pump 33, in order to remove coarse particles of dirt from the washware. The wash liquid sprayed by the prewash nozzles 30 flows back into the prewash tank 36 due to the force of gravity.

The prewash tank 36 is provided with an overflow line 31 which is used to feed the excess quantity of liquid to a waste water system if a liquid level in the prewash tank 36 is exceeded.

As already indicated, the liquid sprayed in the main-wash zone 14 and in the prewash zone 12 preferably contains detergent which is added in a metered fashion with the aid of a detergent metering apparatus (not shown in the drawings), for example, to the liquid accommodated in the main-wash tank 34 of the main-wash zone 14.

As already mentioned, the final rinse zone 18 is followed by the drying zone 40 in the conveying direction 8. In the drying zone 40, the washware is dried using dry and heated air in order to blow off and/or dry up the moisture on the washware. In order to keep the moisture content of the air in a range which is expedient for drying, it is feasible, for example, to supply external room air to the drying zone 40 via an opening, for example through the outlet opening for the washware.

The warm and moisture-laden air in the drying zone 40 is then drawn-off from the drying zone 40 via a further opening, for example with the aid of a fan 41. It is advantageous here if the exhaust-air stream from the drying zone 40 passes a heat recovery device 42 in which, for example, a condenser can be provided. The heat recovery device 42 serves to recover at least some of the thermal energy contained in the exhaust air.

If, before initial starting of the conveyor dishwasher 2, the tanks (prewash tank 36, main-wash tank 34, postwash tank 32) associated with the individual wash zones 12, 14 and 16 are empty or insufficiently filled, the tanks first have to be filled with fresh water via a fresh water line 90 and/or by spraying final rinse liquid in the final rinse zone 18. The fresh water line 90 can be connected to a fresh water supply system via an actuable valve V3. The quantity of wash liquid available in the main-wash zone 14 and in the prewash zone 12 can in each case be monitored and signalled to a control device 50 with the aid of a level sensor provided in the main-wash tank 34 and with the aid of a level sensor provided in the prewash tank 36.

The final rinse zone 18 can—as illustrated in FIG. 1—have an associated fresh water container 30 for temporarily storing at least a portion of the fresh water provided for final rising purposes. The fresh water container 30 is firstly provided with a fresh water connection which can be connected to a fresh water supply system via an actuable fresh water feed valve V2, and secondly is connected to the intake end of a final rinse pump 43. However, it goes without saying that it is also feasible to dispense with a fresh water container 30 for temporarily storing at least a portion of the fresh water provided for final rinsing purposes and to connect the fresh water feed valve V2 directly to the intake end of the final rinse pump 43.

The delivery end of the final rinse pump 43 is connected to a water heater 9 (boiler) via a line system. In this case, the line system is designed in such a way that the liquid delivered from the final rinse pump 43 to the spray nozzles 20, 22, 24 of the final rinse zone 18 first passes the heat recovery device 42 before reaching the water heater 9. In this way, it is possible to use at least some of the thermal energy from the discharged exhaust air to heat up the liquid supplied to the spray nozzles 20, 22, 24 of the final rinse zone 18.

Rinse aid is added in a metered fashion with the aid of a rinse aid metering apparatus 57 to the fresh water which is supplied to the final rinse pump 43 either directly by the fresh water feed valve V2 or by the fresh water container 30. The rinse aid metering apparatus 57 is particularly preferably arranged in such a way that rinse aid is added in a metered fashion to the fresh water in a position in which the fresh water is not yet heated. Experiments have shown that the rinse aid and fresh water mix significantly better and more uniformly when the rinse aid is added in a metered fashion to unheated fresh water. Specifically, rinse aid should be added in a metered manner to fresh water which is at a temperature of less than 40° C., and preferably less than 30° C. For this reason, rinse aid is added in a metered fashion between the final rinse pump 43 and the water heater 9 or the heat recovery device 42 in the embodiment of the conveyor dishwasher 2 illustrated in FIG. 1. To this end, a feed line which issues between the final rinse pump 43 and the heat recovery device 42 and can be connected to the rinse aid metering apparatus 57 via a rinse aid pump 56 is provided in the line system.

The abovementioned control apparatus 50 is schematically indicated in the conveyor dishwasher 2 illustrated in FIG. 1. The control apparatus 50 is designed to automatically set the quantity of final rinse liquid sprayed in the final rinse zone 18 per unit time. The control apparatus 50 is preferably designed to actuate different actuable components of the conveyor dishwasher 2, for example the respective pumps and valves, in accordance with a predefined or predefinable programme sequence in order to thus be able to set the process parameters in the individual treatment zones 12, 14, 16, 18 of the conveyor dishwasher 2, and in particular the process parameters in the final rinse zone 18.

It is also preferred when the conveying speed at which the washware is conveyed in the conveying direction 8 through the respective treatment zones 12, 14, 16, 18 can be set with the aid of the control apparatus 50.

According to the invention, the quantity of final rinse liquid sprayed in the final rinse zone 18 per unit time is automatically changed with the aid of the control apparatus 50 as a function of the conveying speed at which the washware is conveyed at least through the final rinse zone 18 and/or as a function of the type of washware conveyed through the at least one final rinse zone 18. In the conveyor dishwasher 2 illustrated in FIG. 1, the control apparatus 50 is designed to selectively automatically change the quantity of final rinse liquid sprayed in the final rinse zone 18 per unit time as a function of the type of washware conveyed through the at least one final rinse zone 18 or as a function of the conveying speed. However, it also feasible, in principle, for the control apparatus 50 to be designed to change the quantity of final rinse liquid sprayed in the final rinse zone 18 per unit time only as a function of the type of washware conveyed through the at least one final rinse zone 18, or only as a function of the conveying speed.

In order to detect the type of washware to be treated in the conveyor dishwasher 2, the conveyor dishwasher 2 illustrated in FIG. 1 has a washware detector apparatus 51. The term "washware detector apparatus" used here is to be understood as any detection apparatus which is designed to detect and/or to determine the type of washware to be treated in the conveyor dishwasher 2. It is feasible for the washware detector apparatus 51 to have at least one detector device which can detect the size and/or the shape and/or the material of the washware to be treated in the conveyor dishwasher 2. In one possible implementation of the washware detector apparatus 51, it comprises at least one preferably optically, inductively or capacitively operating detector device, so that the size, the shape and/or the material of the washware can be directly detected for the purpose of identifying the type of washware. However, other types of detector, for example inductively operating proximity sensors, light sensors, light curtains, laser scanners, 3D lasers, cameras, rotary transducers, etc., can be used as the detector device.

As illustrated in FIG. 1, the washware detector apparatus 51 is preferably arranged at the inlet 11 of the conveyor dishwasher 2, so that it is possible to detect the type of washware to be supplied to the individual treatment zones 12, 14, 16, 18, 40 of the conveyor dishwasher 2. However, it goes without saying that it would also be feasible to arrange the washware detector apparatus 51 in the interior of the conveyor dishwasher 2. The important factor is that the washware detector apparatus 51 is arranged at least upstream of the inlet into the final rinse zone 18.

The control apparatus 50 is connected to the washware detector apparatus 51 in particular via a suitable communication connection, in order for the type of washware supplied to the conveyor dishwasher 2 and detected by the washware detector apparatus 51 to be checked continuously or at predetermined times and/or as predetermined events occur.

In the embodiment of a conveyor dishwasher 2 according to the invention illustrated in FIG. 1, the control arrangement 50 is designed such that the washware to be treated can be detected automatically on the basis of the type of washware detected by the washware detector apparatus 51. The control apparatus 50 can preferably automatically detect at least the following washware:

- plates produced from porcelain or a porcelain-like material;
- cups produced from porcelain or a porcelain-like material, glass or a glass-like material;
- bowls produced from porcelain or a porcelain-like material, glass or a glass-like material;
- trays, or tray-like articles, produced from a plastic material;
- containers, in particular GN containers, produced from a metal, in particular from stainless steel;
- pots produced from a metal, in particular from stainless steel;
- pans produced from a metal, in particular from stainless steel;
- cutlery or items of cutlery produced from a metal, in particular from stainless steel; and
- drinking glasses produced from glass or a glass-like material.

If the control apparatus 50 does not identify the washware on the basis of the type of washware detected by the washware detector apparatus 51, the relevant washware is identified as "other washware".

The solution according to the invention is distinguished not just by the automatic identification of the washware to be treated but also by the additional functionality of the control apparatus 50, according to which this control arrangement is designed to automatically select a predefined or predefinable treatment programme in the final rinse zone 18 and to set the process parameters of the selected treatment programme as a function of the detected type of washware and/or as a function of the conveying speed. Process parameters which can be set by the control apparatus 50 as a function of the detected type of washware and/or as a function of the conveying speed include, in particular, the quantity of final rinse liquid sprayed in the final rinse zone 18 per unit time. Accordingly, it is preferred for the control apparatus 50 to be designed to correspondingly actuate the final rinse pump 43. In this case, the final rinse pump 43 is preferably designed as a rotation-speed-controlled pump.

In order for the control apparatus 50 to be able to correspondingly automatically define the quantity of final rinse liquid to be sprayed in the final rinse zone 18 per unit time and to correspondingly actuate the final rinse pump 43 as a function of the detected type of washware and/or as a function of the conveying speed, it is feasible for the control apparatus 50 to have a memory device (not explicitly illustrated in FIG. 1) which can be accessed by the control apparatus 50 and in which treatment programmes and corresponding process parameters for final rinsing in the final rinse zone 18 are stored for the individual types of washware or conveying speeds which may occur.

This can effectively prevent over-treatment of the washware in the final rinse zone 18. Even a relatively low quantity of final rinse liquid sprayed in the final rinse zone 18 per unit time is often sufficient for an adequate final rinse result.

According to the invention, provision is made for a constant quantity of rinse aid to be added in metered fashion per unit time, with the aid of the rinse aid metering apparatus 57, to the fresh water provided for final rinsing purposes independently of the quantity of final rinse liquid sprayed in the final rinse zone 18 per unit time. In this way, it is possible for the rinse aid metering apparatus 57 to be functionally decoupled from the control apparatus 50. In other words, rinse aid is added in a metered fashion independently of the treatment programme in the final rinse zone 18 selected with the aid of the control apparatus 50 and the process parameters correspondingly set by the control apparatus 50. This permits the rinse aid metering apparatus 57 to be used in the conveyor dishwasher 2 as an independent module. Therefore, the conveyor dishwasher 2 can be of modular construction, this resulting in considerable advantages, for example when servicing the conveyor dishwasher 2.

The rinse aid metering apparatus 57 should preferably be designed with a constant quantity per unit time input such that it adds 0.2 to 0.8 ml of rinse aid, and preferably 0.3 to 0.6 ml of rinse aid, per liter of fresh water in a metered fashion to the fresh water provided for final rinsing purposes independently of the quantity of final rinse liquid sprayed in the final rinse zone 18 per unit time (e.g, when a low volume final rinse liquid is sprayed per unit time the quantity of rinse aid added may be about 0.6 ml per liter of fresh water and when a high volume of finaly rinse liquid is sprayed per unit time the quantity of rinse aid added may be about 0.3 ml per liter of fresh water). Experiments have shown that no negative effects on the final rinse result are to be expected with these metered quantities. As already indicated, the rinse aid should be added in a metered fashion to unheated fresh water for the purpose of optimum mixing of the rinse aid with the fresh water.

In a preferred implementation of the conveyor dishwasher 2 illustrated in FIG. 1, the control apparatus 50 is designed to automatically set the quantity of final rinse liquid sprayed in the at least one final rinse zone 18 per unit time to a predefined or predefinable (e.g., user or service person changeable or settable) value when glasses or racks of glasses are identified, this being done, in particular, independently of the selected and set conveying speed.

As an alternative or in addition to this, it is further preferred for the control apparatus 50 to be designed to automatically set the quantity of final rinse liquid sprayed in the at least one final rinse zone 18 per unit time to a predefined or predefinable value when items of cutlery or racks of cutlery are identified, this likewise being done independently of the conveying speed.

In a preferred implementation of the solution according to the invention, the following final rinse liquid volumetric flows are automatically set in a flight-type dishwasher with a passage width of 612 mm:

- the final rinse liquid volumetric flow is set to a value greater than or equal to 200 l/h, independently of the conveying speed, when glasses or racks of glasses are detected; and
- the final rinse liquid volumetric flow is set to a value greater than or equal to 200 l/h, independently of the conveying speed, when cutlery or racks of cutlery are detected.

In this implementation of the solution according to the invention, the dependence of the final rinse liquid volumetric flow on the conveying speed occurs only in the case of types of washware which differ from the "glasses" type of washware or the "cutlery" type of washware. The following final rinse liquid volumetric flows are to be set for these other types of washware:

- a final rinse liquid volumetric flow of approximately 150 l/h is automatically set for a conveying speed of >1 m/min;
- a final rinse liquid volumetric flow of approximately 180 l/h is automatically set for a conveying speed of <1.5 m/min;
- a final rinse liquid volumetric flow of approximately 210 l/h is automatically set for a conveying speed of >1.5 m/min; and
- a final rinse liquid volumetric flow of approximately 240 l/h is automatically set for a conveying speed of >2 m/min;

The abovementioned values for the conveying speed and for the final rinse liquid volumetric flow are only examples. It goes without saying that it is also feasible to change the final rinse liquid volumetric flow as a function of the conveying speed when glasses are detected or when cutlery is detected.

FIG. 2 is a cross-sectional view of the final rinse zone 18 of the conveyor dishwasher 2 according to FIG. 1. As already indicated above, the final rinse zone 18 has downwardly directed upper spray nozzles 20, upwardly directed lower spray nozzles 22 and transversely directed lateral spray nozzles 24 on either side of the conveyor apparatus 4. However, it goes without saying that it is also feasible for only upper and lower spray nozzles 20, 22, and no transversely directed lateral spray nozzles 24, to be provided in the final rinse zone 18. However, it is advantageous for only upper and lower spray nozzles 20, 22 but also lateral spray nozzles 24 to be used at least for final rinsing purposes, in order to thus permit areas of the washware to be sprayed in a targeted manner in shadow zones too, and in order, in particular, to also be able to ensure effective rinsing-off of detergent residues from washware surfaces even in shadow zones when the conveying system is fully loaded.

The invention is not restricted to the embodiments of FIG. 1 and FIG. 2 shown by way of example in the drawings. Rather, the invention can be gathered from an overall examination of the claims and the description of the exemplary embodiment by a person skilled in the art.

The invention claimed is:

1. A conveyor dishwasher comprising a conveyor apparatus for conveying washware through at least one wash zone and at least one final rinse zone, with final rinse liquid, which comprises fresh water and rinse aid which is added in a metered fashion, being sprayed onto the washware in the at least one final rinse zone by means of spray nozzles, characterized in that a control apparatus is provided for automatically setting a quantity of final rinse liquid sprayed in the at least one final rinse zone per unit time as a function of a conveying speed at which the washware is conveyed through the at least one final rinse zone and/or as a function of a type of washware conveyed through the at least one final rinse zone; and in that a rinse aid metering apparatus is connected to a feed line to feed rinse aid into a final rinse path that feeds the final rinse liquid to the nozzles, wherein the rinse aid metering apparatus is designed to automatically add in a metered fashion a constant quantity of rinse aid per unit time to the fresh water provided for final rinsing purposes independently of the quantity of final rinse liquid sprayed in the at least one final rinse zone per unit time.

2. A cconveyor dishwasher according to claim 1, characterized in that an apparatus which is arranged between the rinse aid metering apparatus and the spray nozzles of the at least one final rinse zone is provided for heating up the final rinse liquid after the rinse aid has been added.

3. A cconveyor dishwasher according to claim 1, characterized in that the rinse aid metering apparatus is arranged relative to a fresh water feed line system in such a way that rinse aid is added in a metered fashion to the fresh water in a position in which the fresh water is at a temperature of less than 40° C.

4. A cconveyor dishwasher according to claim 1, characterized in that the rinse aid metering apparatus is designed to add in a metered fashion 0.2 to 0.8 ml of rinse aid per liter of fresh water to the fresh water provided for final rinsing purposes independently of the quantity of final rinse liquid sprayed in the at least one final rinse zone per unit time.

5. A conveyor dishwasher according to claim 1, characterized in that a washware detector apparatus is provided which is designed to detect the type of washware to be treated; and in that the control apparatus is designed to automatically set the quantity of final rinse liquid sprayed in the at least one final rinse zone per unit time as a function of the detected type of washware to be treated.

6. A conveyor dishwasher according to claim 1, characterized in that a final rinse pump which can be actuated by the control apparatus is provided for setting the quantity of final rinse liquid supplied to the spray nozzles of the at least one final rinse zone per unit time, with the final rinse pump being a rotation-speed-controlled pump.

7. A conveyor dishwasher according to claim 5,characterized in that the control apparatus is designed to automatically set the conveying speed at which the washware is conveyed through the at least one final rinse zone with the aid of the conveyor apparatus as a function of the detected type of washware to be treated.

8. A conveyor dishwasher according to claim 7, characterized in that the washware detector apparatus has at least one optically operating detector device and/or at least one inductively or capacitively operating detector device and is designed to automatically identify glasses or racks of glasses and/or to automatically identify cutlery or racks of cutlery; and in that the control apparatus is designed to automatically set the quantity of final rinse liquid sprayed in the at least one final rinse zone per unit time to a first predefined or predefinable value when glasses or racks of glasses are identified; and/or in that the control apparatus is designed to automatically set the quantity of final rinse liquid sprayed in the at least one final rinse zone per unit time to a second predefined or predefinable value when items of cutlery or racks of cutlery are identified.

9. A conveyor dishwasher according to claim 8, characterized in that, in order to spray the final rinse liquid, the at least one final rinse zone has at least one downwardly directed upper spray nozzle, at least one upwardly directed lower spray nozzle and at least one lateral spray nozzle.

10. A method for operating a conveyor dishwasher for washing washware which is conveyed through at least one wash zone and at least one final rinse zone with the aid of a conveyor apparatus, with final rinse liquid which comprises fresh water and rinse aid which is added in a metered fashion being sprayed onto the washware in the at least one final rinse zone by means of spray nozzles, characterized in that a quantity of final rinse liquid sprayed in the at least one final rinse zone per unit time is automatically set as a function of a conveying speed at which the washware is conveyed through the at least one final rinse zone and/or as a function of a type of washware conveyed through the at least one final rinse zone; and in that a constant quantity of rinse aid is automatically added, into a final rinse path that feeds the final rinse liquid to the spray nozzles wherein the rinse aid is added, in a metered fashion per unit time to the fresh water provided for final rinsing purposes independently of the quantity of final rinse liquid sprayed in the at least one final rinse zone per unit time.

11. A method according to claim 10, characterized in that rinse aid is added in a metered fashion to the fresh water in such a way that a concentration of rinse aid is in a range of between 0.2 and 0.8 ml per liter of fresh water.

12. A method according to claim 10, characterized in that the rinse aid is metered into fresh water which is at a temperature of less than 40° C.

13. A method according to claim 10, characterized in that the type of washware to be treated is detected; and the quantity of final rinse liquid sprayed in the at least one final rinse zone per unit time is automatically set as a function of the detected type of washware to be treated.

14. A method according to claim 10, characterized in that the conveying speed at which the washware is conveyed at least through the at least one final rinse zone with the aid of the conveyor apparatus is automatically set as a function of the detected type of washware to be treated.

* * * * *